US012350553B2

(12) United States Patent
Engle et al.

(10) Patent No.: US 12,350,553 B2
(45) Date of Patent: Jul. 8, 2025

(54) GOLF BALL DIMPLE PROFILE DEFINED BY PIECEWISE FUNCTION

(71) Applicant: Acushnet Company, Fairhaven, MA (US)

(72) Inventors: Courtney N. Engle, Fall River, MA (US); Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 137 days.

(21) Appl. No.: 18/236,180

(22) Filed: Aug. 21, 2023

(65) Prior Publication Data

US 2025/0065192 A1 Feb. 27, 2025

(51) Int. Cl.
*A63B 37/06* (2006.01)
*A63B 37/00* (2006.01)

(52) U.S. Cl.
CPC ..... *A63B 37/0012* (2013.01); *A63B 37/0019* (2013.01); *A63B 37/002* (2013.01)

(58) Field of Classification Search
CPC ..... A63B 37/0012; A63B 37/0019; A63B 37/002
See application file for complete search history.

(56) References Cited

U.S. PATENT DOCUMENTS 4,925,193 A 5/1990 Melvin et al.
4,979,747 A 12/1990 Jonkouski
5,016,887 A 5/1991 Jonkouski
5,249,804 A 10/1993 Sanchez
5,497,996 A 3/1996 Cadorniga
5,562,552 A 10/1996 Thurman
5,575,477 A 11/1996 Hwang
5,713,801 A 2/1998 Aoyama
5,803,831 A 9/1998 Sullivan et al.
5,857,924 A 1/1999 Miyagawa et al.
5,885,172 A 3/1999 Hebert
5,902,193 A 5/1999 Shimosaka et al.
5,919,100 A 7/1999 Boehm et al.
5,965,669 A 10/1999 Cavallaro et al.
5,981,654 A 11/1999 Rajagopalan
5,981,658 A 11/1999 Rajagopalan et al.
6,149,535 A 11/2000 Bissonnette et al.
6,162,136 A 12/2000 Aoyama
6,331,150 B1 12/2001 Ogg
6,796,912 B2 9/2004 Dalton et al.
7,018,308 B2 3/2006 Kasashima
7,163,472 B2 1/2007 Dalton et al.
7,491,137 B2 2/2009 Bissonnette et al.
7,641,572 B2 1/2010 Aoyama et al.
7,887,439 B2 2/2011 Aoyama et al.
9,782,628 B2 10/2017 Madson et al.
(Continued)

*Primary Examiner* — Raeann Gorden
(74) *Attorney, Agent, or Firm* — Thomas P. Gushue

(57) ABSTRACT

A golf ball dimple half profile is disclosed herein that can be defined by a piecewise function. The sub-functions that define the piecewise function can include, for example, a catenary function and a Gabriel's horn function. A transition between the sub-functions defining the piecewise function is smooth. The sub-functions can have opposing concavities, and at least one of the sub-functions can have a non-constant radius of curvature. The golf ball dimple half profile is rotated about the dimple's centroid to create the full dimple profile.

13 Claims, 4 Drawing Sheets

(56) References Cited

U.S. PATENT DOCUMENTS

| | | | | |
|---|---|---|---|---|
| 9,782,630 | B2 | 10/2017 | Madson et al. | |
| 10,232,223 | B2 | 3/2019 | Madson et al. | |
| 10,758,785 | B2 | 9/2020 | Madson et al. | |
| 2001/0005700 | A1 | 6/2001 | Kasashima et al. | |
| 2007/0015609 | A1 | 1/2007 | Kasashima et al. | |
| 2007/0117655 | A1 | 5/2007 | Kasashima et al. | |
| 2007/0142129 | A1 | 6/2007 | Kasashima et al. | |
| 2013/0172124 | A1 | 7/2013 | Hixenbaugh et al. | |
| 2013/0172127 | A1 | 7/2013 | Hixenbaugh et al. | |
| 2017/0136304 | A1* | 5/2017 | Nardacci ..... | A63B 37/0007 |
| 2020/0398115 | A1 | 12/2020 | Madson et al. | |

* cited by examiner

GOLF BALL DIMPLE PROFILE DEFINED BY PIECEWISE FUNCTION

FIELD OF THE INVENTION

The present invention relates to a golf ball dimple profile, and more particularly relates to the contour of the dimple surface being defined by juxtaposed curves.

BACKGROUND OF THE INVENTION

Golf balls were originally made with smooth outer surfaces. In the late nineteenth century, players observed that the gutta-percha golf balls traveled further as they got older and more gouged up. The players then began to roughen the surface of new golf balls with a hammer to increase flight distance. Manufacturers soon caught on and began molding non-smooth outer surfaces on golf balls.

By the mid-1900s, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST® 384, which had 384 dimples that were arranged in an icosahedral pattern. About 76 percent of its outer surface was covered with dimples and the golf ball exhibited improved aerodynamic performance. Today, dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point air separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., a thin layer of air adjacent to the ball flows in a turbulent manner. The turbulence energizes the boundary layer of air around the ball and helps the air stay attached further around the ball to reduce the area of the wake. This greatly increases the pressure behind the ball and substantially reduces the drag. Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Golf ball manufacturers extensively study the effect of dimple shape, volume, and cross-section on overall flight performance of the ball. Golf ball dimples having two different spherical radii with an inflection point where the two curves meet are known. In most cases, however, the cross-sectional profiles of dimples in prior art golf balls are parabolic curves, ellipses, semi-spherical curves, saucer-shaped, a sine curve, a truncated cone, or a flattened trapezoid. One disadvantage of these shapes is that they can sharply intrude into the surface of the ball, which may cause the drag to become greater than the lift. As a result, the ball may not make best use of momentum initially imparted thereto, resulting in an insufficient carry of the ball.

It would generally be desirable to provide a golf ball dimple profile that is comprised of at least two different or distinct curves or functions having a seamless transition to provide additional capabilities for high performing aerodynamic golf balls.

SUMMARY OF THE INVENTION

In one example, a golf ball having a plurality of dimples on a surface thereof is disclosed herein. At least a first group of the plurality of dimples has a cross-sectional profile (i.e. a cross-sectional dimple profile) defined by x-y coordinates, wherein x=0 corresponds to a central axis of the cross-sectional profile (i.e., at a centroid of the golf ball dimple profile), and y=0 corresponds to a maximum depth of the cross-sectional profile which is defined at the central axis of the cross-sectional profile or the centroid of the golf ball dimple profile. The cross-sectional profile can be symmetrical about the central axis, such that the cross-sectional profile is comprised of a cross-sectional half profile that is rotated about x=0. The cross-sectional half profile can be defined by a piecewise function (y) comprised of a first function ($y_1$) and a second function ($y_2$), and the piecewise function (y) can be rotated about x=0 to define the full cross-sectional profile of the dimple. Accordingly, the full cross-sectional profile of the dimple is also defined by the piecewise function (y) with the inclusion of negative x values and equivalent inequality boundaries, as understood by one with ordinary skill in the art. These first and second functions ($y_1$, $y_2$) can be referred to as sub-functions.

The first function ($y_1$) and the second function ($y_2$) can intersect at at least one intersection point ($x_c$, $y_c$) such that:

$$y = \begin{cases} y_1, & 0 \le x \le x_C \\ y_2, & x > x_c \end{cases}, \text{ and } \frac{dy_1}{dx} = \frac{dy_2}{dx} \text{ at } x = x_c,$$

Rotation of the piecewise function (y) about the central axis of x=0, i.e., the centroid of the golf ball dimple profile, generates the full or entire cross-sectional golf ball dimple profile. Accordingly, the first function ($y_1$) and the second function ($y_2$) can intersect at least one intersection point ($-x_c$, $y_c$) such that:

$$y = \begin{cases} y_1, & 0 \ge x \ge -x_C \\ y_2, & x < -x_c \end{cases}, \text{ and } \frac{dy_1}{dx} = \frac{dy_2}{dx} \text{ at } x = -x_c,$$

The first function ($y_1$) and the second function ($y_2$) can have opposing directions of concavity. One of ordinary skill in the art would understand that the entire golf ball dimple profile consists of a golf ball dimple half profile, which is defined by the piecewise function (y), that is rotated about the central axis to define the entire or full cross-sectional dimple profile. At least one of the first function ($y_1$) or the second function ($y_2$) can have a non-constant radius of curvature. Both of the first and second functions ($y_1$, $y_2$) can have a non-constant radius of curvature.

The first function ($y_1$) can be defined by:

$$y_1 = \frac{d\,(\cosh(SF \cdot x) - 1)}{\cosh\left(SF \cdot \frac{d}{2}\right) - 1},\ 0 \le x \le x_c$$

where SF is a shape factor, and the shape factor (SF) is within the following range: 1≤SF≤1,000.

The second function ($y_2$) can be defined by:

$$y_2 = \frac{c_d\left(\frac{d}{2}\right)\left(\frac{1}{x_c} - \frac{1}{x}\right)}{HF - 1} + \frac{d\,(\cosh(SF \cdot x) - 1)}{\cosh\left(SF \cdot \frac{d}{2}\right) - 1},\ x > x_c$$

where HF is a horn factor, and the horn factor (HF) is defined by:

$$HF = 1 + \frac{c_d\left(\cosh\left(SF \cdot \frac{d}{2}\right) - 1\right)}{2 \cdot SF \cdot x_c^2 \cdot \sinh(SF \cdot x_c)}$$

A dimple diameter (d) of the plurality of dimples can be within the following range: 0.100 inches≤d≤0.200 inches. A chord depth ($c_d$) of the plurality of dimples can be within the following range: 0.001 inches≤$c_d$≤0.010 inches.

A y-coordinate of the intersection point ($y_c$) can be defined by the following equation:

$$y_c = \kappa * c_d$$

where κ is a fraction of a total chord depth (in inches) that is contributed by the first function ($y_1$), and where $c_d$ is a chord depth (in inches) of the plurality of dimples. Accordingly, κ is referred to herein as a chord depth-contribution factor.

An x-coordinate of the intersection point ($x_c$) can be defined by the following equation:

$$x_c = \frac{1}{SF}\cosh^{-1}\left(\frac{\kappa \cdot c_d\left(\cosh\left(SF \cdot \frac{d}{2}\right) - 1\right)}{d} + 1\right)$$

where the shape factor (SF) is within the following range: 1≤SF≤1,000.

The following equation can be used to define the chord depth-contribution factor (κ):

$$0.3207 - 0.8512\,d + 2.7961\,c_d \le \kappa \le 0.4509 - 0.5435\,d + 1.8818\,c_d$$

The plurality of the dimples can include at least 50% of the plurality of dimples. In another example, the plurality of the dimples can include 100% of the plurality of dimples.

The first function ($y_1$) can be defined by a catenary function, and the second function ($y_2$) can be defined by a Gabriel's horn function. One of ordinary skill in the art would understand that other functions can be used to define the golf ball dimple profile.

In another example, a golf ball having a plurality of dimples on a surface thereof is provided. At least a first group of the plurality of dimples has a cross-sectional profile defined by x-y coordinates, where x=0 corresponds to a central axis of the cross-sectional profile, y=0 corresponds to a maximum depth of the cross-sectional profile, and the cross-sectional profile is symmetrical about the central axis.

The cross-sectional half profile can be comprised of a piecewise function (y) defined by a first function ($y_1$) and a second function ($y_2$). The first function ($y_1$) and the second function ($y_2$) intersect at at least one intersection point ($x_c$, $y_c$) such that:

$$y = \begin{cases} y_1,\ 0 \le x \le x_C \\ y_2,\ x > x_c \end{cases},\ \text{and}\ \frac{dy_1}{dx} = \frac{dy_2}{dx}\ \text{at}\ x = x_c$$

The first function ($y_1$) can be defined by a catenary function, and the second function ($y_2$) can be defined by a Gabriel's horn function.

The first function ($y_1$) and the second function ($y_2$) can have opposing directions of concavity, and at least one of the first function ($y_1$) or the second function ($y_2$) can have a non-constant radius of curvature.

In this example, the first function ($y_1$) and the second function ($y_2$) can be defined by:

$$\begin{cases} y_1 = \frac{d\,(\cosh(SF \cdot x) - 1)}{\cosh\left(SF \cdot \frac{d}{2}\right) - 1},\ 0 \le x \le x_c \\ y_2 = \frac{c_d\left(\frac{d}{2}\right)\left(\frac{1}{x_c} - \frac{1}{x}\right)}{HF - 1} + \frac{d\,(\cosh(SF \cdot x) - 1)}{\cosh\left(SF \cdot \frac{d}{2}\right) - 1},\ x > x_c \end{cases}$$

where the shape factor (SF) is within the following range: 1≤SF≤1,000, and where the horn factor (HF) is defined by:

$$HF = 1 + \frac{c_d\left(\cosh\left(SF \cdot \frac{d}{2}\right) - 1\right)}{2 \cdot SF \cdot x_c^2 \cdot \sinh(SF \cdot x_c)}$$

In yet another example, a golf ball having a plurality of dimples on a surface thereof is provided. At least a first group of the plurality of dimples has a cross-sectional profile defined by x-y coordinates, where x=0 corresponds to a central axis of the cross-sectional profile, y=0 corresponds to a maximum depth of the cross-sectional profile, and the cross-sectional profile is symmetrical about the central axis.

The cross-sectional half profile can be comprised of a piecewise function (y) defined by a first function ($y_1$) and a second function ($y_2$). The first function ($y_1$) and the second function ($y_2$) can intersect at an intersection point ($x_c$, $y_c$), and the first function ($y_1$) and the second function ($y_2$) are smooth, continuous, and tangential at the intersection point ($x_c$, $y_c$). The first function ($y_1$) can be defined by a catenary function, and the second function ($y_2$) can be defined by a Gabriel's horn function. The y-coordinate of the intersection point ($y_c$) can be defined by the following equation:

$$y_c = \kappa * c_d$$

In some embodiments, it is preferred that all of the dimple profiles on the golf ball are similar. However, in other embodiments, the profiles can be varied over the surface of the golf ball and the dimples can have different dimple diameters and depths.

BRIEF DESCRIPTION OF DRAWINGS

These and other aspects of the present invention may be more fully understood with references to, but not limited by, the following drawings.

DETAILED DESCRIPTION

According to one aspect, the present disclosure is directed to a golf ball having at least one dimple cross-sectional half profile using at least two curves with a smooth transition between the curving functions, at least one of the two curves having a non-constant radius of curvature (i.e., at least one curve is not circular), and concavities among the at least two curves are opposite from each other.

Figure 1A:
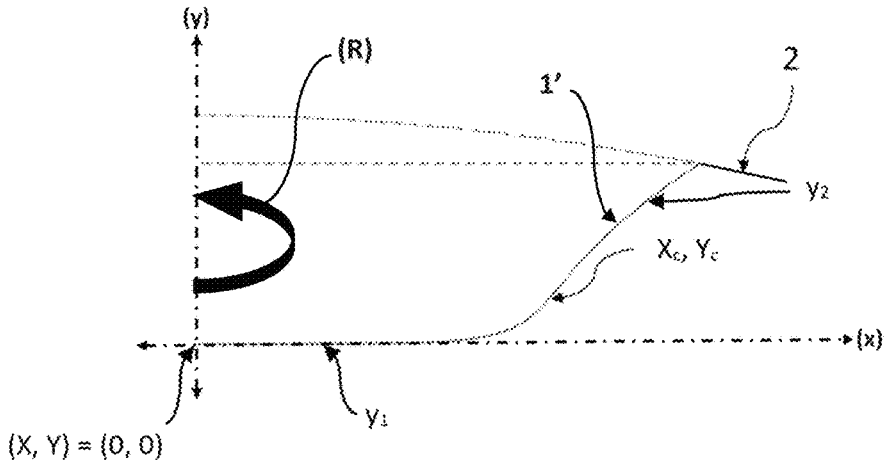
FIG. 1A is a diagram illustrating a golf ball dimple half profile according to one example.

Several examples of golf ball dimple profiles according to the present disclosure are illustrated in FIGS. 1B, and 2A-2D. FIG. 1A illustrates the golf ball dimple half profile associated with the golf ball dimple profile of FIG. 1B.

Figure 1B:
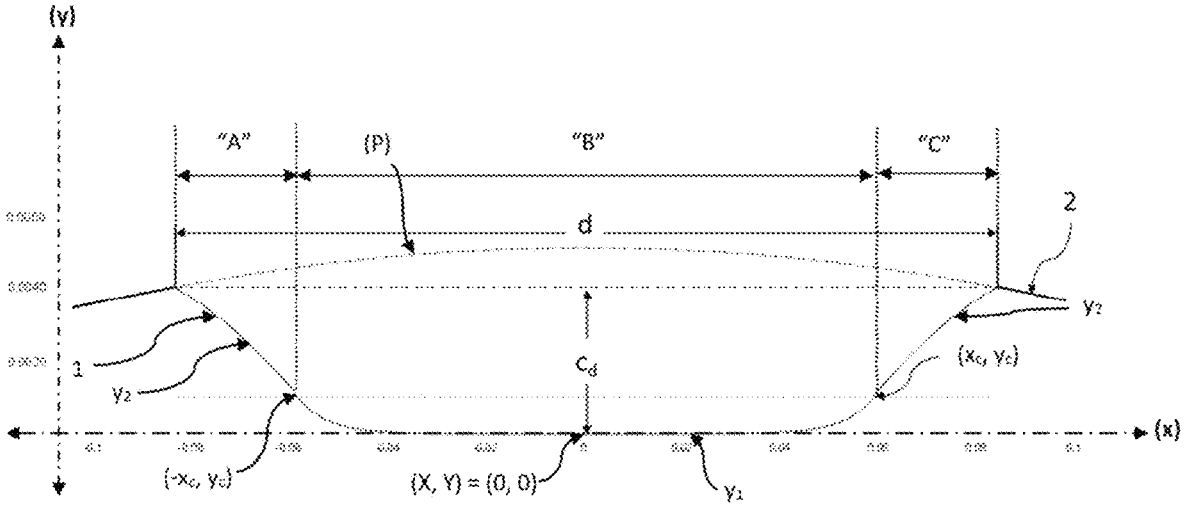
FIG. 1B is a diagram illustrating a full golf ball dimple profile according to the half profile of FIG. 1A.

FIG. 1B illustrates a golf ball dimple profile 1 defined by at least two curves ($y_1$) and ($y_2$) that intersect at at least one intersection point ($-x_c$, $y_c$; $x_c$, $y_c$). The golf ball dimple profile 1 is defined as being recessed relative to a golf ball landing surface 2 surrounding the golf ball dimple. A phantom surface (P) for the golf ball surface is also shown in FIG. 1B.

As shown in FIG. 1B, the golf ball dimple has a diameter (d) and a chord depth ($c_d$). The diameter (d) of the golf ball dimple can be 0.100 inches-0.200 inches, in some examples. In other examples, the diameter (d) of the golf ball dimple can be 0.050 inches-0.300 inches. The chord depth ($c_d$) can be 0.001 inches-0.010 inches, in some examples. In other examples, the chord depth ($c_d$) can be 0.0005 inches-0.020 inches. One of ordinary skill in the art would understand that the diameter (d) and the chord depth ($c_d$) of the golf ball dimple profile can vary.

The present golf ball dimple profile can be used for all of the dimples on a golf ball surface in one example. In another example, the present golf ball dimple profile can be used for at least 50% of the golf ball dimples on a golf ball surface. In another example, the present golf ball dimple profile can be used for no more than 50% of the golf ball dimples on a golf ball surface. In another example, the present golf ball dimple profile can be used for at least 75% of the golf ball dimples on a golf ball surface. For those dimples having a profile shape different from the profile illustrated in FIG. 1B, that profile may be spherical, catenary, saucer, conical, or other similarly known profiles. One of ordinary skill in the art understands multiple types of the profiles may also be used in concert.

In one example, the total number of dimples may be 300-400. In another example, the total number of dimples may be 225-575. In another example, the total number of dimples may be 150-224. In another example, the total number of dimples may be 225-275. In another example, the total number of dimples may be 276-425. In another example, the total number of dimples may be 426-550. In another example, the total number of dimples may be 551-625. In other examples, the total number of dimples may be 225-300, or 400-500, or 500-575.

In one example, the dimples may cover at least 70% of the ball surface. In another example, the dimples may cover at least 80% of the ball surface.

The golf ball dimple profile 1 of FIG. 1B can be comprised of a golf ball dimple half profile (i.e., curve 1' in FIG. 1A) defined by at least one first function ($y_1$) and at least one second function ($y_2$). The golf ball dimple half profile 1' can be a combined or composite profile that is formed via juxtaposition of at least two functions. The golf ball dimple half profile 1' can therefore be a piecewise function. In one example, the golf ball dimple half profile 1' can be defined by more than two functions.

The golf ball dimple profile 1 can be designed such that the transitional point or intersection point between the at least two functions defines a smooth transition. Stated differently, the derivative of the first function ($y_1$) and the derivative of the second function ($y_2$) at a transitional point or intersection point are equal.

The at least two functions forming the golf ball dimple half profile can have different concavities such that one function is concave and the other function is convex. In one example, the first function ($y_1$) is a catenary curve function and is concave, and the second function ($y_2$) can have a Gabriel's horn function and is convex. In another example, both functions or profiles defining the golf ball dimple half profile can have the same concavity and the present disclosure can be adapted such that a smooth transition is defined between said functions.

In one aspect, the golf ball dimple half profile 1' defines at least one intersection point ($x_c$, $y_c$), which can also be referred to as an inflection or transitional point, between the two functions ($y_1$) and ($y_2$). As shown in FIG. 1B, the x-coordinates of two intersection points ($-x_c$, $x_c$) can be defined by the golf ball dimple profile 1, with a single intersection point being defined within each half of the golf ball dimple profile. As shown in FIG. 1B, the centroid of the golf ball dimple profile 1 is defined at point x=0. The golf ball dimple profile 1 can be symmetrical about the centroid of the golf ball dimple profile 1. One of ordinary skill in the art would understand that a single intersection point within each half of the golf ball dimple can be used, or more than two intersection points within each half of the golf ball dimple can be used. In one specific example, two functions can define the golf ball dimple half profile, and the two functions can alternate being on and off while maintaining tangency and smoothness. In another specific example, three or more functions can be used to define the golf ball dimple half profile, and a plurality of intersection points can be defined along the golf ball dimple half profile. One of ordinary skill in the art would appreciate from the present disclosure that the half and/or full golf ball dimple profile can be defined by one, two, three, or more functions depending on the dimple profile generative methodology. Depending on the particular frame of reference, the full golf ball dimple profile can be considered to be comprised of three piecewise functions, including a left segment (i.e., section "A" in FIG. 1B), a middle or medial segment (i.e., section "B" in FIG. 1B), and a right segment (i.e., section "C" in FIG. 1B). In one aspect, the left and right segments are mirror images of each other.

The first function ($y_1$) can have a catenary curve profile. Golf ball dimple profiles having catenary curves are further disclosed, for example, in U.S. Pat. Nos. 7,163,472, 7,641,572, and 9,782,630, which are each commonly assigned to Acushnet Company, and which are each hereby incorporated by reference in their entirety as if fully set forth herein.

The second function ($y_2$) can be defined by a Gabriel's horn function. Golf ball dimple profiles defined by a Gabriel's horn function are disclosed in U.S. Patent Pub. Nos. 2013/0172127 and 2013/0172124, which are each commonly assigned to Acushnet Company, and which are each hereby incorporated by reference in their entirety as if fully set forth herein.

As shown in FIG. 1B, the golf ball dimple profile 1 can be comprised of at least three sections "A," "B," and "C." As shown in FIG. 1B, the first section "A" and the third section "C" can be defined by a Gabriel's horn function. The second section "B" can be defined by the catenary curve function. As shown in FIG. 1B, section "A" corresponds to the profile defined by a Gabriel's horn function and associated with negative x coordinates, section "C" corresponds to the profile defined by a Gabriel's horn function and associated with positive x coordinates, and section "B" corresponds to the profile defined by the catenary curve function and associated with both negative x coordinates and positive x coordinates, as well as x=0. One of ordinary skill in the art would understand that additional sections could be included, and the additional sections could be comprised or defined by other functions or profiles. In one example, the golf ball dimple profile 1 consists exactly of the three sections "A," "B." and "C."

In one example, the golf ball dimple profile 1 has a chord depth-contribution factor (κ) of 0.20-0.40, i.e., the golf ball dimple profile 1 is comprised of 20%-40% of the catenary curve function. In one example, the golf ball dimple profile 1 has a chord depth-contribution factor (κ) of 0.25-0.35, i.e., the golf ball dimple profile 1 is comprised of 25%-35% of the catenary curve function. In one example, the golf ball dimple profile 1 has a chord depth-contribution factor (κ) of 0.28-0.32, i.e., the golf ball dimple profile 1 is comprised of 30% (+/−2.0%) of the catenary curve function. In one example, a majority of the golf ball dimple profile 1 is defined by the catenary curve function. In another example, a majority of the golf ball dimple profile 1 is defined by the Gabriel's horn function. In another example, the golf ball dimple profile 1 has a chord depth-contribution factor (κ) of 0.50. In another example, the golf ball dimple profile 1 has a chord depth-contribution factor (κ) of 0.01-0.99. One of ordinary skill in the art would understand that the exemplary chord depth-contribution factors (κ) will vary depending on the chord depth and dimple diameters for various golf ball dimple profiles.

The cross-sectional dimple half profile can be defined by a piecewise function comprised of two functions, ($y_1$) and ($y_2$), both of which have defined, constant directions of concavity and whose concavities are opposite from each other. Additionally, at least one function can have a defined and non-constant radius of curvature (i.e., at least one function is neither linear nor circular). Additionally, the two functions are tangentially connected at the x-coordinate, $x_c$, and the functions are such that:

$$\frac{d}{dx}y_1 = \frac{d}{dx}y_2 \text{ at } x_c.$$

The intersection point ($x_c$) identified above can refer to both the positive and negative x-coordinates as shown in the Figures. In one particular embodiment, the cross-sectional half profile of the dimple is comprised of a catenary function section and a Gabriel's horn function section. The horn factor (HF) can be specifically configured to ensure the profile has perfect tangency. Stated differently, the transition between the catenary function section and the Gabriel's horn function section is smooth. In one aspect, the term horn factor (HF) refers to a dependent variable that is selected or defined in order to meet the smooth transition or tangency between the two functions that define the piecewise function for the golf ball dimple half profile. The horn factor (HF) can be a dependent variable, as compared to independent variables in the present disclosure, which can include dimple diameter (d), chord depth ($c_d$), shape factor (SF), chord depth-contribution factor (κ), etc.

Using the present definition of the horn factor (HF), values of the horn factor (HF) near 1 can provide a relatively gradual curve for the Gabriel's horn function, while larger values of the horn factor (HF), such as a horn factor (HF) near 1.2 can provide a relatively steep curve for the Gabriel's horn function.

The horn factor (HF) can be defined by:

$$HF = 1 + \frac{c_d\left(\cosh\left(SF \cdot \frac{d}{2}\right) - 1\right)}{2 \cdot SF \cdot x_c^2 \cdot \sinh(SF \cdot x_c)}$$

The profile of the dimples can be defined by:

$$\begin{cases} y_1 = \dfrac{d(\cosh(SF \cdot x) - 1)}{\cosh\left(SF \cdot \frac{d}{2}\right) - 1}, & 0 \le x \le x_c \\ y_2 = \dfrac{c_d\left(\frac{d}{2}\right)\left(\frac{1}{x_c} - \frac{1}{x}\right)}{HF - 1} + \dfrac{d(\cosh(SF \cdot x) - 1)}{\cosh\left(SF \cdot \frac{d}{2}\right) - 1}, & x > x_c \end{cases}$$

where (d) is the dimple diameter, ($c_d$) is the chord depth of the dimple, SF is the shape factor (SF) of the catenary profile, (x) is the horizontal position of the dimple cross section with x=0 coincident with the dimple's center or centroid, (y) is the vertical position of the dimple cross section with y=0 coincident with the lowest (i.e., deepest) part of the dimple, and $x_c$ is the x-coordinate at which the profile transitions from the catenary function to the Gabriel's horn function. The cross-sectional dimple half profile shown in FIG. 1A is defined by a single piecewise function (y) which is defined by the first and second functions ($y_1$, $y_2$) to generate the cross-sectional dimple half profile 1' and rotated about the central axis of the dimple (i.e., the line x=0), to create the full dimple shape. FIG. 1A illustrates an exemplary cross-sectional dimple half profile, and includes an arrow annotation (R) to show an exemplary rotation about the central axis of the dimple to create the full dimple shape.

The shape factor (SF) can be an independent variable in the mathematical function that defines a catenary dimple cross-sectional shape, as further disclosed in, for example, U.S. Pat. Nos. 6,796,912, 7,163,472, 7,491,137, 7,887,439, and 9,782,628, which are each commonly assigned to Acushnet Company, and which are each hereby incorporated by reference in their entirety as if fully set forth herein.

Similar to the horn factor (HF), the shape factor (SF) can be specifically configured to ensure the profile has perfect tangency. Using the present definition of the shape factor (SF), values of the shape factor (SF) that are closer to 1 appear to be more spherical in shape, while much larger values (i.e., over 500) of the shape factor (SF) appear to be more cylindrical in shape. In one aspect, a width or radial size of the catenary section, i.e., the intersection point ($x_c$), can be related to the shape factor (SF). For smaller values of the shape factor (SF), the intersection point ($x_c$) is close to 50% of the dimple radius (i.e., $x_c$=d/4). For larger values of the shape factor (SF), the intersection point ($x_c$) is closer to 100% of the dimple radius (i.e., $x_c$=d/2).

When chord depth ($c_d$) and dimple diameter (d) are defined, there is a mathematical limit for the possible range of x-coordinates of the intersection point ($x_c$). Defining a y-coordinate of the intersection point ($y_c$) results in an expression of the vertical position of the transition point as a function of chord depth ($c_d$):

$$y_c = \kappa * c_d$$

wherein $0<\kappa<1$. As used in this context, the chord depth-contribution factor (κ) is the fraction of the golf ball dimple profile that is governed or controlled by the catenary function. More specifically, the chord depth-distribution factor (κ) is a fraction of the total chord depth ($c_d$) (in inches) that is attributable to a depth (in inches) of the first function ($y_1$) (i.e., the catenary function). The following equation can be used to define the chord depth-contribution factor (κ):

$$0.3207 - 0.8512d + 2.7961c_d \le \kappa \le 0.4509 - 0.5435d + 1.8818c_d$$

The x-coordinate of the intersection point ($x_c$) can be defined as:

$$x_c = \frac{1}{SF}\cosh^{-1}\left(\frac{\kappa \cdot c_d\left(\cosh\left(SF \cdot \frac{d}{2}\right) - 1\right)}{d} + 1\right)$$

With a defined chord depth ($c_d$) and dimple diameter (d), the x-coordinate of the intersection point ($x_c$) depends only upon the ranges for the shape factor (SF) and the chord depth-contribution factor (κ). Not all values of the chord depth-contribution factor (κ) facilitate a mathematically viable result, however, so each chord depth ($c_d$) and dimple diameter (d) have an associated possible range of chord depth-contribution factor (κ) values, as well.

Figure 3:
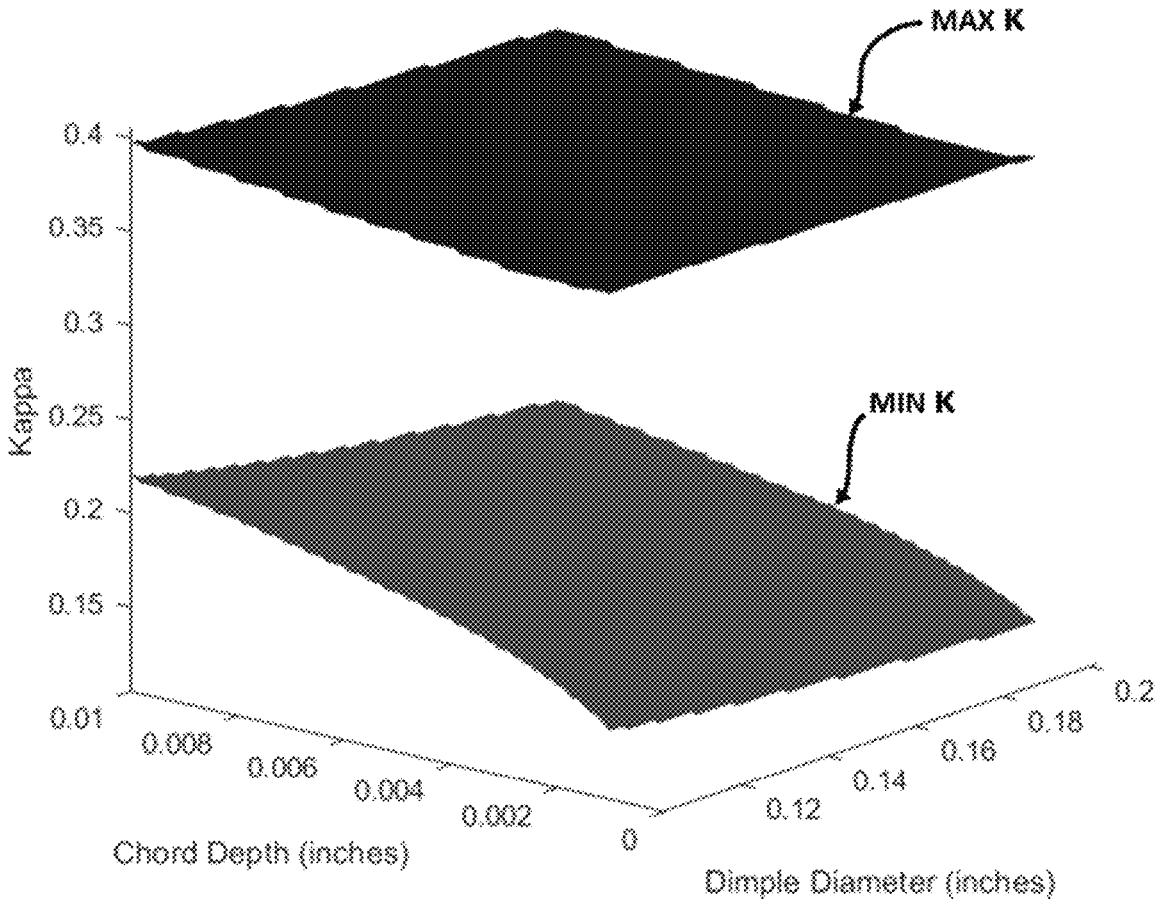
FIG. 3 is an exemplary plot showing maximum and minimum ranges of a chord depth-contribution factor as a function of dimple diameter and chord depth.

In the case of restricting shape factor (SF) to satisfy $1 \le SF \le 1{,}000$, the plot illustrated in FIG. 3 depicts the minimum and maximum possible range of the chord depth-contribution factor (κ) across a range of dimple diameters (d) (i.e., 0.100 inches≤d≤0.200 inches), and a range of chord depths ($c_d$) (i.e., 0.001 inches≤$c_d$≤0.010 inches). In one aspect, the chord depth-contribution factor (κ) can have a minimum of 0.10 and a maximum of 0.40. One of ordinary skill in the art would understand that the value of the chord depth-contribution factor (κ) can vary depending on various factors, such as the dimple diameter, chord depth, and other parameters.

Using the concepts disclosed herein, a golf ball dimple profile can be formed having any one or more of the following functions or curves: circular, elliptical, logarithmic, exponential, Gabriel's horn, sinusoidal, catenary, cardioid, and/or other well-known mathematical curves.

Various exemplary golf ball profiles are further described herein with respect to FIGS. 2A, 2B, 2C, and 2D. In each of the Examples 1-4, the golf ball dimple profile includes sections "A" and "C" which are defined by the Gabriel's horn function, and section "B" which is arranged between sections "A" and "C" and is defined by the catenary function.

Example 1

Figure 2A:
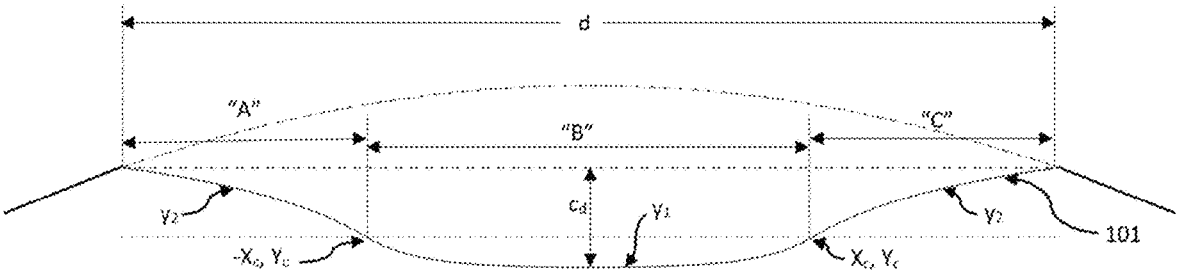
FIG. 2A is a diagram illustrating a golf ball dimple profile according to another example.

FIG. 2A illustrates one exemplary golf ball dimple profile 101. As shown in FIG. 2A, the golf ball dimple profile 101 has a shape factor (SF) of 122, a horn factor (HF) of 1.006, a chord depth ($c_d$) of 0.004 inches, a dimple diameter (d) of 0.15 inches, and an x-coordinate at the intersection point ($x_c$) of 0.0356. In this example, the chord depth-contribution factor (κ) is 0.2042-0.3769.

Example 2

Figure 2B:
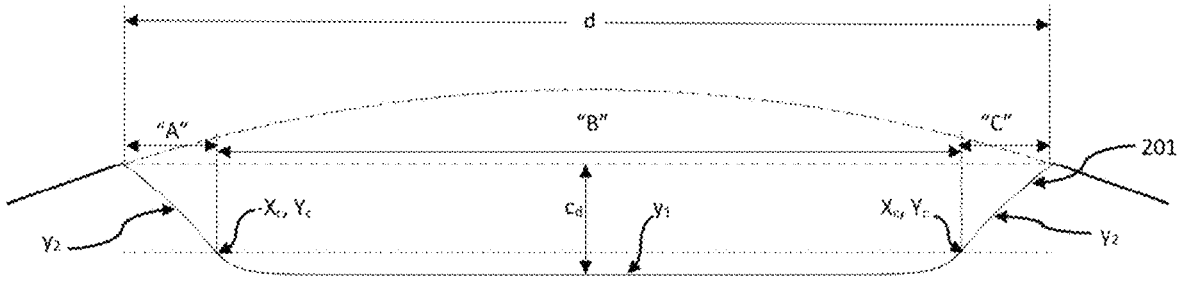
FIG. 2B is a diagram illustrating a golf ball dimple profile according to another example.

FIG. 2B illustrates another exemplary golf ball dimple profile 201. As shown in FIG. 2B, the golf ball dimple profile 201 has a shape factor (SF) of 331, a horn factor (HF) of 1.0081, a chord depth ($c_d$) of 0.005 inches, a dimple diameter (d) of 0.15 inches, and an x-coordinate at the intersection point ($x_c$) of 0.0599. In this example, the chord depth-contribution factor (κ) is 0.2070-0.3788.

Example 3

Figure 2C:
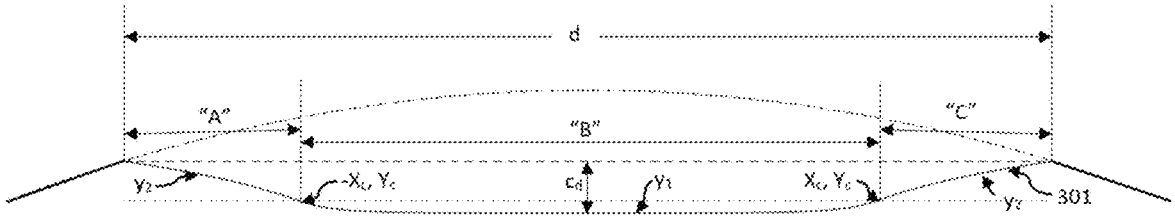
FIG. 2C is a diagram illustrating a golf ball dimple profile according to another example.

FIG. 2C illustrates another exemplary golf ball dimple profile 301. As shown in FIG. 2C, the golf ball dimple profile 301 has a shape factor (SF) of 158, a horn factor (HF) of 1.0036, a chord depth ($c_d$) of 0.0035 inches, a dimple diameter (d) of 0.18 inches, and an x-coordinate at the intersection point ($x_c$) of 0.0558. In this example, the chord depth-contribution factor (κ) is 0.1773-0.3600.

Example 4

Figure 2D:
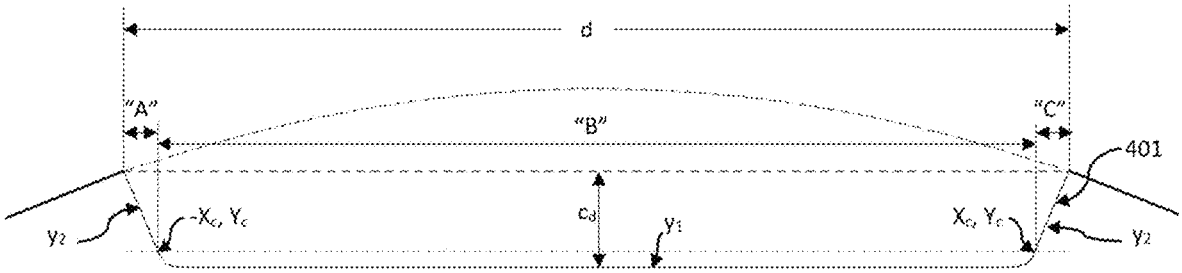
FIG. 2D is a diagram illustrating a golf ball dimple profile according to another example.

FIG. 2D illustrates another exemplary golf ball dimple profile 401. As shown in FIG. 2D, the golf ball dimple profile 401 has a shape factor (SF) of 814, a horn factor (HF) of 1.034, a chord depth ($c_d$) of 0.0055 inches, a dimple diameter (d) of 0.18 inches, and an x-coordinate at the intersection point ($x_c$) of 0.0835. In this example, the chord depth-contribution factor (κ) is 0.1829-0.3634.

The golf ball dimple profile features and parameters disclosed herein provide for greater flexibility in golf ball dimple design and thereby improvements in aerodynamic performance. The golf ball dimple profile features and parameters disclosed herein provide for improvements regarding the design for dimple depth as defined by the distance from the center point of the dimple to the curved phantom surface and the edge angle as defined in U.S. Pat.

No. 6,162,136, which is commonly assigned to Acushnet Company and which is incorporated by reference in its entirety as if fully set forth herein.

Dimple profiles having differing directions of concavity may be beneficial to the aerodynamic performance of the golf ball, particularly those whose profiles nearer the dimple-free land area of the ball are concave while the profile nearer the dimple centroid is convex. In this configuration, the concave/convex curve pairing creates a comparatively shallower effective edge angle than a circular profile while maintaining equivalent dimple volume. Additionally, if one desires to maintain chord depth and reduce dimple volume, the concave/convex profile shape provides an elegant and smooth solution. The smoothness of the transition between the concave and convex regions is of particular importance as it prevents unwanted turbulence generation which would be created by a non-tangential or sharp intersection between the two functions. The elimination of a sharp intersection between the two functions also improves the visual appearance of the dimpled golf ball.

The present disclosure may be used with any type of golf ball construction. For instance, the ball may have a 2-piece construction, a double cover or veneer cover construction or other multi-layer constructions depending on the type of performance desired of the ball. Examples of these and other types of ball constructions that may be used with the present disclosure include those described in U.S. Pat. Nos. 5,713,801, 5,803,831, 5,885,172, 5,919,100, 5,965,669, 5,981,654, 5,981,658, and 6,149,535, which are each hereby incorporated by reference in their entirety as if fully set forth herein.

Different materials also may be used in the construction of the golf balls made with the present disclosure. For example, the cover of the ball may be made of polyurethane, ionomer resin, balata or any other suitable cover material known to those skilled in the art. Different materials also may be used for forming core and intermediate layers of the golf ball.

The golf ball dimple profiles of the present disclosure can be part of a dimple pattern selected to achieve a particular desired lift coefficient, a desired appearance, and/or various desired aerodynamic characteristics. Dimple patterns that provide a high percentage of surface coverage are preferred, and are well known in the art. For example, U.S. Pat. Nos. 5,562,552, 5,575,477, 5,249,804, and 4,925,193, which are each hereby incorporated by reference in their entirety as if fully set forth herein, disclose geometric patterns for positioning dimples on a golf ball.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball having a plurality of dimples on a surface thereof, wherein at least a first group of the plurality of dimples has a cross-sectional dimple profile defined by x-y coordinates, wherein x=0 corresponds to a central axis of the cross-sectional dimple profile, y=0 corresponds to a maximum depth of the cross-sectional dimple profile which is defined at the central axis, and the cross-sectional dimple profile is symmetrical about the central axis, wherein a cross-sectional dimple half profile is defined by a piecewise function (y) comprised of a first function ($y_1$) and a second function ($y_2$), and the piecewise function (y) is rotated about the central axis to define the cross-sectional dimple profile, wherein the first function ($y_1$) and the second function ($y_2$) intersect at an intersection point ($x_c$, $y_c$) such that:

$$y = \begin{cases} y_1, & 0 \le x \le x_c \\ y_2, & x > x_c \end{cases},$$

and $$\frac{dy_1}{dx} = \frac{dy_2}{dx}$$

at $x = x_c$, wherein the first function ($y_1$) and the second function ($y_2$) have opposing directions of concavity, wherein at least one of the first function ($y_1$) or the second function ($y_2$) has a non-constant radius of curvature, and wherein the first function ($y_1$) is defined by a catenary function, and the second function ($y_2$) is defined by a Gabriel's horn function.

2. The golf ball according to claim 1, wherein the first function ($y_1$) is defined by:

$$y_1 = \frac{d(\cosh(SF \cdot x) - 1)}{\cosh\left(SF \cdot \frac{d}{2}\right) - 1},$$

$$0 \le x \le x_c$$

where SF is a shape factor, the shape factor SF is within the following range: 1≤SF≤1,000.

3. The golf ball according to claim 1, wherein the second function ($y_2$) is defined by:

$$y_2 = \frac{c_d\left(\frac{d}{2}\right)\left(\frac{1}{x_c} - \frac{1}{x}\right)}{HF - 1} + \frac{d(\cosh(SF \cdot x) - 1)}{\cosh\left(SF \cdot \frac{d}{2}\right) - 1},$$

$$x > x_c$$

where SF is a shape factor, and SF is within the following range: 1≤SF≤1,000, and where HF is a horn factor, and HF is defined by:

$$HF = 1 + \frac{c_d\left(\cosh\left(SF \cdot \frac{d}{2}\right) - 1\right)}{2 \cdot SF \cdot x_c^2 \cdot \sinh(SF \cdot x_c)}.$$

4. The golf ball according to claim 1, wherein a diameter (d) of the first group of the plurality of dimples is within the following range: 0.100 inches≤d≤0.200 inches.

5. The golf ball according to claim 1, wherein a chord depth ($c_d$) of the first group of the plurality of dimples is within the following range: 0.001 inches≤$c_d$≤0.010 inches.

6. The golf ball according to claim 1, wherein the first function ($y_1$) and the second function ($y_2$) are defined by:

$$\begin{cases} y_1 = \dfrac{d(\cosh(SF \cdot x) - 1)}{\cosh\left(SF \cdot \dfrac{d}{2}\right) - 1}, & 0 \le x \le x_c \\ y_2 = \dfrac{c_d\left(\dfrac{d}{2}\right)\left(\dfrac{1}{x_c} - \dfrac{1}{x}\right)}{HF - 1} + \dfrac{d(\cosh(SF \cdot x) - 1)}{\cosh\left(SF \cdot \dfrac{d}{2}\right) - 1}, & x > x_c \end{cases}$$

where SF is a shape factor, and SF is within the following range: 1≤SF≤1,000, where $c_d$ is a chord depth (in inches) of the first group of the plurality of dimples, where d is a diameter (in inches) of the first group of the plurality of dimples, and where HF is a horn factor, and HF is defined by:

$$HF = 1 + \frac{c_d\left(\cosh\left(SF \cdot \frac{d}{2}\right) - 1\right)}{2 \cdot SF \cdot x_c^2 \cdot \sinh(SF \cdot x_c)}.$$

7. The golf ball according to claim 6, wherein a diameter (d) of the first group of the plurality of dimples is within the following range: 0.100 inches≤d≤0.200 inches.

8. The golf ball according to claim 7, wherein a chord depth ($c_d$) of the first group of the plurality of dimples is within the following range: 0.001 inches≤$c_d$≤0.010 inches.

9. The golf ball according to claim 1, wherein a y-coordinate of the intersection point ($x_c$, $y_c$) is defined by the following equation:

$$y_c = \kappa * c_d$$

where κ is a chord depth-contribution factor defined as fraction of a total chord depth (in inches) that is attributable to a depth (in inches) of the first function ($y_1$), and where $c_d$ is a chord depth (in inches) of the first group of the plurality of dimples.

10. The golf ball according to claim 9, wherein an x-coordinate of the intersection point ($x_c$, $y_c$) is defined by the following equation:

$$x_c = \frac{1}{SF}\cosh^{-1}\left(\frac{\kappa \cdot c_d\left(\cosh\left(SF \cdot \frac{d}{2}\right) - 1\right)}{d} + 1\right)$$

where SF is a shape factor, and SF is within the following range: 1≤SF≤1,000.

11. The golf ball according to claim 9, wherein the chord depth-contribution factor κ is defined by the following equation:

$$0.3207 - 0.8512d + 2.7961c_d \le \kappa \le 0.4509 - 0.5435d + 1.8818c_d.$$

12. The golf ball according to claim 1, wherein the first group of the plurality of the dimples includes at least 50% of the plurality of dimples.

13. The golf ball according to claim 1, wherein the first group of the plurality of the dimples includes 100% of the plurality of dimples.

* * * * *